United States Patent [19]

Ritter

[11] 4,010,883

[45] Mar. 8, 1977

[54] THREAD DELIVERY DEVICE FOR TEXTILE MACHINES

[75] Inventor: Helmut Ritter, Wattwil, Switzerland

[73] Assignee: Herberlein & Co. AG, Wattwil, Switzerland

[22] Filed: Oct. 15, 1975

[21] Appl. No.: 622,718

[30] Foreign Application Priority Data

Oct. 30, 1974 Switzerland ..... 14519/74

[52] U.S. Cl. ..... 226/171; 74/242.15 R; 74/221; 271/274

[51] Int. Cl.[2] ..... B65H 51/32

[58] Field of Search ..... 226/171, 172; 198/167, 198/208; 271/274, 273, 275; 74/242.15 R, 221

[56] References Cited

UNITED STATES PATENTS 3,831,830 8/1974 Venot ..... 226/171

FOREIGN PATENTS OR APPLICATIONS 1,149,841 7/1957 France ..... 226/171

*Primary Examiner*—Evon C. Blunk
*Assistant Examiner*—Bruce H. Stoner, Jr.
*Attorney, Agent, or Firm*—Larson, Taylor and Hinds

[57] ABSTRACT

A thread delivery device, particularly for use with a texturing device, is described wherein an endless belt runs over two freely mounted rollers on a pivotable support. In the operative position of the support, the belt between the rollers contacts a power driven cylinder over a predetermined wrap angle. In this position, an adjustable abutment keeps a spring loaded belt guide element out of contact with the belt. However, when the support is swung to an inoperative position in which the belt is withdrawn from the driving cylinder, the abutment ceases to be effective so that the guide element, which is carried by a pivotally mounted arm to which the spring is applied, engages the belt and takes up the slack that would otherwise appear due to the elimination of the wrap on the cylinder. The spring may be connected either to the support or to a fixed part.

4 Claims, 2 Drawing Figures

THREAD DELIVERY DEVICE FOR TEXTILE MACHINES

FIELD OF THE INVENTION

The present invention relates to a thread delivery device for textile machines, particularly for texturing devices, such as for example false-twist devices.

DESCRIPTION OF THE PRIOR ART

In thread delivery devices of this kind, an endless belt passes over two rollers the axes of which extend in parallel relationship with respect to each other and a cylinder engages the outer surface of the belt between the two rollers. The cylinder simultaneously serves as a driving element, being rotated by a power input.

The force with which such a delivery device can drive the thread is either obtained by the pressure exerted by the belt on the cylinder or by the wrap angle, or length of arc, over which the belt is in contact with the cylinder, or by a combination of these two factors. If a large wrap angle is provided when the belt is in operation, the belt, in the inoperative position, hangs very loosely on the two rollers which, when the delivery device is started, may lead to disturbances in the operation and to filament breakages.

It has therefore been proposed to keep the belt, when in the non-operative condition, in a tensioned state by means of a spring loaded pivoting arm on which is disposed a belt guiding element. Upon starting, when the belt is brought into contact with the cylinder the tension arising in the belt as a result of its engagement with the cylinder over a wrap angle, causes the pivoting arm to move against the spring force until the belt runs straight through the guiding element.

The disadvantage of this solution consists in that because of continuous force exerted on the belt by the spring-loaded arm, the belt is subject to considerable wear. Furthermore, between the belt guide portion of the pivoting arm and the belt, much dirt is collected which is transferred to the rollers supporting the belt and causes irregular running of the belt.

SUMMARY OF THE INVENTION

It is the purpose of the present invention to avoid the disadvantages of the known devices and to provide a thread delivery device in which disturbances and filament breakages are reduced to a minimum and which facilitates the starting of the textile machine on which the device is used.

Accordingly, the object of the present invention consists in a thread delivery device for textile machines, comprising a driven cylinder against which a belt can be pressed, which belt is endless and passes around rollers arranged on a pivotable support, the belt in the non-operative position being tensioned by a spring-biased pivotable arm comprising a guide element, which, when a position of the belt support arm is reached in which the belt is in contact with the cylinder over a predetermined wrap angle, is lifted away from the belt.

With the device of the present invention, an essentially reduced wear of the belt in comparison with the known device is achieved, and soiling of the belt by electrostatically charged particles is avoided to a great extent.

DESCRIPTION OF THE DRAWINGS

An example of the invention will hereinafter be described with reference to the figures of the attached drawing wherein, merely schematically.

Figure 1:
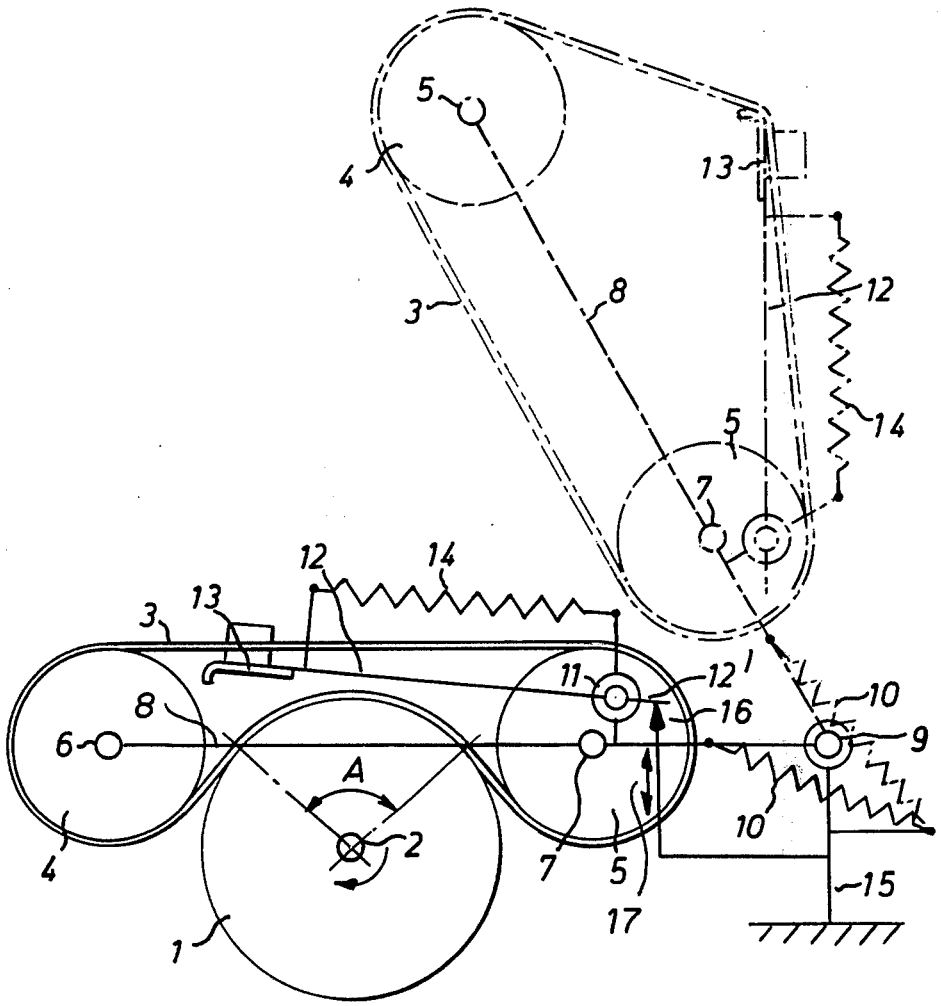
FIG. 1 shows a lateral elevation of the thread delivery device, an inactive condition of the device being shown in broken lines and the active condition in full lines.

The delivery device shown in the drawings comprises a driving cylinder 1 which is continuously rotated about a stationary axle 2 as well as an endless belt 3 which is supported by two rollers 4 and 5 which are mounted on axles 6 and 7 for free rotation. The axles 6 and 7 are mounted on a support arm 8 which can be pivoted around an axle 9 which is stationary with respect to the axis of driving cylinder 1. To the support arm 8, furthermore, one end of a tension spring 10 is fixed, the other end of which is connected with a part 15 fixed on the frame of a machine in which the delivery device is incorporated.

The delivery device furthermore comprises an arm 12, pivotable around an axle 11 and carrying a belt guide element 13. The axle 11 is mounted on the support arm 8. On the pivotable arm 12, one end of a tension spring 14 is fixed, the other end of which is rigidly connected to the support arm 8. It is however also possible to fix the other end of the tension spring 14 to the stationary part 15. On the pivotable arm 12, there is furthermore provided a projection 12' which cooperates with an adjustable abutment 16 on the stationary part 15 whereby the pivotable arm 12 can be set in a predetermined position.

Figure 2:
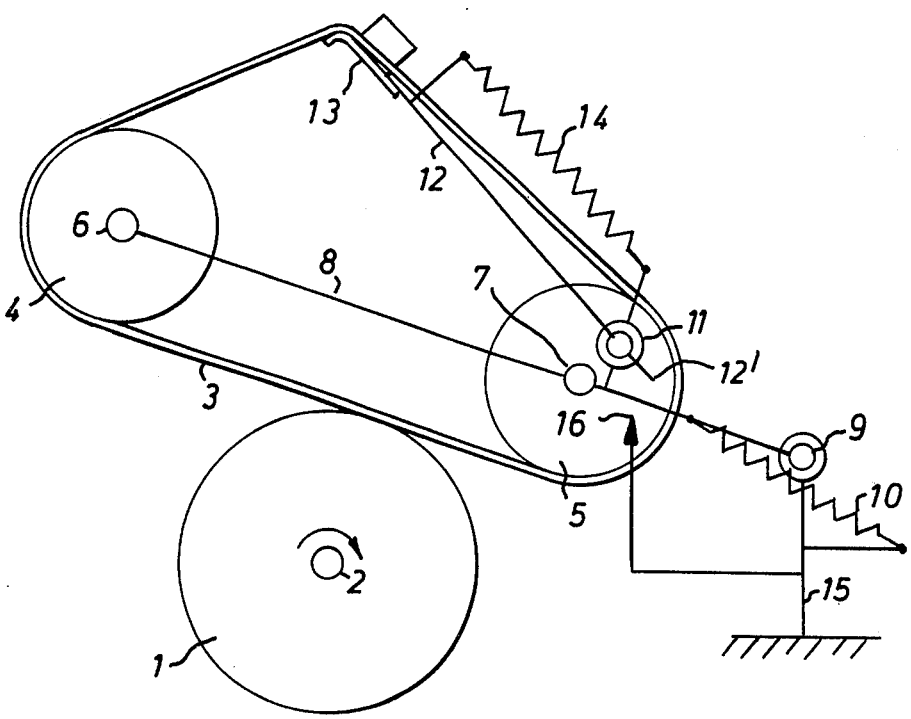
FIG. 2 shows a lateral elevation of the same device in a condition intermediate the conditions shown in FIG. 1.

The manner in which the above-described device is operated is as follows:

In the ineffective position (shown by thin lines in FIG. 1), in which the belt 3 and the driving cylinder 1 are at a certain distance from each other, the pivotable arm 12 is maintained in a position under the effect of tension spring 14, in which the guide element 13 keeps the belt 3 in a tensioned state. The belt 3 also remains tensioned in the intermediate position shown in FIG. 2, in which it is only in line contact with cylinder 1, i.e. in which the wrap angle is practically zero. As soon as the belt 3 is in contact with the cylinder 1 over a predetermined angular zone, as a result of the support arm 8 being in a corresponding position, the projection 12' of pivotable arm 12 abuts against abutment 16 provided on part 15 rendering the tension spring 14 ineffective and the pivotable arm 12 is set in a position in which the guide element 13 is at a certain distance from the belt 3 and the belt is only tensioned by a component of force of the spring 10 corresponding to the position of the support arm 8 which presses the belt 3 against the driving cylinder 1. The support arm is pressed downwards against cylinder 1 until the wrap angle has reached the value A and the delivery device is in operating position (indicated by full lines in FIG. 1). Advantageously, the abutment 16 can be adjusted longitudinally as indicated by arrow 17 in FIG. 1, so that the guide element 13 of the pivotable arm 12 is only lifted off from the belt 3 shortly before the operative position is reached whereupon the belt is again tensioned only by tension spring 10.

I claim:

1. A thread delivery device for a textile machine comprising means providing a first stationary axis, a cylinder mounted coaxially with said axis to be driven thereabout, a pivotable support mounted to swing to and fro about a second stationary axis parallel to said first mentioned axis, spaced rollers mounted for free rotation about spaced parallel axes on said pivotable support, an endless belt embracing said rollers and contacting said cylinder over a predetermined wrap angle when said pivotable support is in an operative position, whereby said cylinder can cause said belt to circulate about said rollers, a pivotally mounted arm, a guide element mounted on said arm to pivot therewith towards and away from a location traversed by said belt when caused to circulate about said rollers, a spring operative on said arm to bias said guide element towards said location, means impeding said guide element from reaching said location when said pivotable support is in said operative position and for freeing said arm to the action of said spring when said pivotable support is moved about said second stationary axis towards an inoperative position wherein said belt is separated from said cylinder, whereupon said guide element engages said belt and removes slack therein.

2. A thread delivery device according to claim 1, in which said arm is pivotally mounted on said pivotable support.

3. A thread delivery device according to claim 2, in which said spring is a tension spring connected between said arm and said pivotable support.

4. A thread delivery device according to claim 1, in which said arm is formed with a projection, said device including also an adjustable abutment member located to engage said projection to impede said guide element from reaching said location, when said pivotable support is in said operative position, and for said projection to be separated therefrom when said pivotable support is in the said inoperative position.

* * * * *